US009979097B2

(12) United States Patent
Nipper

(10) Patent No.: US 9,979,097 B2
(45) Date of Patent: May 22, 2018

(54) EXPANDING LATTICE NOTCH ARRAY ANTENNA AND METHOD OF FABRICATION

(71) Applicant: Raytheon Company, Waltham, MA (US)

(72) Inventor: Joseph P. Nipper, Allen, TX (US)

(73) Assignee: Raytheon Company, Waltham, MA (US)

( * ) Notice: Subject to any disclaimer, the term of this patent is extended or adjusted under 35 U.S.C. 154(b) by 261 days.

(21) Appl. No.: 15/071,457

(22) Filed: Mar. 16, 2016

(65) Prior Publication Data

US 2017/0271782 A1 Sep. 21, 2017

(51) Int. Cl.

| | |
|---|---|
| ***H01Q 21/30*** | (2006.01) |
| ***H01Q 21/00*** | (2006.01) |
| ***H01Q 1/08*** | (2006.01) |
| ***H01Q 13/08*** | (2006.01) |
| ***H01Q 21/06*** | (2006.01) |
| ***H01Q 21/24*** | (2006.01) |

(52) U.S. Cl.

CPC ..... *H01Q 21/30* (2013.01); *H01Q 1/085* (2013.01); *H01Q 13/085* (2013.01); *H01Q 21/0087* (2013.01); *H01Q 21/064* (2013.01); *H01Q 21/24* (2013.01)

(58) Field of Classification Search

CPC .. H01Q 1/085; H01Q 21/0087; H01Q 21/064; H01Q 21/24; H01Q 21/30; H01Q 13/085

See application file for complete search history.

(56) References Cited

U.S. PATENT DOCUMENTS

| | | | | |
|---|---|---|---|---|
| 5,220,330 | A | 6/1993 | Salvail et al. | |
| 5,786,792 | A * | 7/1998 | Bellus | H01Q 13/085 343/767 |
| 6,005,531 | A | 12/1999 | Cassen et al. | |
| 6,034,633 | A | 3/2000 | Cassen et al. | |
| 6,839,036 | B1 | 1/2005 | Apostolos et al. | |
| 6,850,204 | B1 | 2/2005 | Angelucci | |
| 7,057,570 | B2 | 6/2006 | Irion, II et al. | |

(Continued)

OTHER PUBLICATIONS

Notice of Allowance dated Nov. 22, 2016 for U.S. Appl. No. 14/958,235; 14 pages.

(Continued)

*Primary Examiner* — Daniel J Munoz

(74) *Attorney, Agent, or Firm* — Daly, Crowley, Mofford & Durkee, LLP

(57) ABSTRACT

The present disclosure is directed toward methods for forming an expanding lattice notch array antenna that includes a plurality of notch antenna elements extending from a surface of a base plate. The properties and dimensions of the notch antenna elements can be manipulated in order to provide an expanding notch array antenna whereby an area of a base portion of the array is different from an area of a top portion of the array, without increasing an overall height of the notch array antenna. The method includes coupling a first plurality of notch elements to a first surface of a base plate in a first orientation, expanding a second plurality of notch elements from a first state to a second state and coupling the second plurality of notch elements in the second state to the first surface of the base plate in a second orientation.

19 Claims, 8 Drawing Sheets

(56) References Cited

U.S. PATENT DOCUMENTS

| | | | |
|---|---|---|---|
| 8,350,773 | B1 | 1/2013 | Kindt |
| 8,466,846 | B1 | 6/2013 | Elsallal et al. |
| 8,736,505 | B2 | 5/2014 | Lambert et al. |
| 9,270,027 | B2 | 2/2016 | Waschenko et al. |
| 2005/0264448 | A1 | 12/2005 | Cox et al. |

OTHER PUBLICATIONS

PCT International Search Report and Written Opinion of the ISA for PCT No. PCT/US2015/054400 dated Jan. 27, 2016; 11 pages.
U.S. Appl. No. 14/958,235, filed Dec. 3, 2015, Richard T. Remski.
PCT Search Report and Written Opinion of the ISA for PCT/US2016/064311 dated Feb. 28, 2017; 13 Pages.

* cited by examiner

EXPANDING LATTICE NOTCH ARRAY ANTENNA AND METHOD OF FABRICATION

GOVERNMENT INTERESTS

This invention was made with the government support under Contract No. N00019-13-C-0128 awarded by the U.S. Navy. The government has certain rights in this invention.

BACKGROUND

As known in the art, notch antenna elements (or "notch radiators" or more simply "notches") are frequently used in the design of linear and planar array antennas. Such arrays may operate with multiple polarizations. The spacing between notches is referred to as the "lattice spacing" or "lattice constant" (if the spacing between notch elements does not change) of the array, and is constrained by electromagnetic principles to be no greater than a certain value in order to prevent unwanted array characteristics known as Bragg or grating lobes. On the other hand, minimum spacing is constrained by the ability to package and integrate the electronics to provide signals to and from the array, as well as the economics of total antenna element and active channel count which increases with decreasing spacing between elements in the array, generally (e.g. the greater the element and action chemical count, the greater the cast of the array).

Attempts to properly size array antennas provided from notch radiators in confined spaces, such as airborne pods, missile bodies, wing leading edges, etc. is therefore a balance between ideally maximizing the total array area while fitting within available volume. If it is necessary to package electronics more densely than desired for the array, a "dilation" layer is typically employed which mechanically translates the necessary connections from the electronics spacing to the notch element spacing. Such dilation layers add depth to the overall system and also add signal loss in the system.

Correspondingly, in the opposite direction, if electronics cannot be packaged down to the scale needed for the desired array spacing that prevents grating lobes, a dilation layer having a negative scale factor permits connection of the necessary feeds from the larger electronics spacing to the smaller array element spacing. This too adds depth to the overall installation and incurs power losses.

SUMMARY

The present disclosure is directed toward methods for forming an expanding lattice notch array antenna, such a notch array antenna includes a plurality of notch antenna elements (or "notch elements" or more simply "notches") extending (or projecting) from a surface of a base plate. The properties and dimensions of the notch antenna elements can be manipulated in order to provide an expanding notch array antenna such that an area of a base portion of the array is different from an area of a top portion of the array, without increasing an overall height of the notch array antenna. In some embodiments, one or more notch elements having a specific level of flexibility or degree of freedom can be used to form the expanding lattice notch array antenna. The two or more notch elements can be stretched from a first state (e.g., relaxed state) to a second state (e.g., stretched state) during production to allow such stretched notched elements to be properly disposed over two or more other notch elements. Further, the elements may contract toward the first state once they have been disposed in a desired position, over the two or more other notch elements.

By modifying the spatial relationships between notch antenna elements in the array while at the same time maintaining a height of the notch array antenna, an expanding lattice notch array antenna is provided which avoids both an increase to overall assembly depth and the additional path losses associated with the dilation as a separate layer.

In one aspect, the present disclosure is directed toward a method for forming an expanding lattice notch antenna. The method includes coupling a first linear array of notch elements to a first surface of a base plate in a first orientation. The method further includes expanding a second linear array of notch elements from a first state to a second state. In an embodiment, the second linear array of notch elements have a larger length in the second state than in the first state. The method further includes coupling the second linear array of notch elements in the second state to the first surface of the base plate in a second orientation and such that each of the second linear array of notch elements are coupled to at least one notch element in the first linear array of notch elements. The first orientation may be perpendicular to the second orientation.

In some embodiments, the method includes coupling the second plurality of notch elements to the first plurality of notch elements such that intersection between them includes an edge of at least one notch element in the second plurality of notch elements and an edge of at least one notch element in the first plurality of notch elements. Thus, a plurality of the notch antenna elements can be formed on the first surface of the base plate. In an embodiment, a base area of each of the plurality of notch antenna elements is less than a top area of each of the plurality of notch antenna elements.

In some embodiments, the first plurality of notch elements can be formed into a plurality of rows on the first surface of the base plate. Each of the plurality of rows may have two or more notch elements coupled together. A groove may be formed in a top portion of each notch element in the first plurality of notch elements to couple the first plurality of notch elements to at least one notch element in the second plurality of notch elements.

In some embodiments, the second plurality of notch elements can be formed into a plurality of rows on the first surface of the base plate. Each of the plurality of rows may have two or more notch elements coupled together. A slot can be formed in a middle portion of each notch element in the second plurality of notch elements to receive at least one notch element in the first plurality of notch elements. In some embodiments, the method includes expanding the slot from a first width in the first state to a second width in the second state. The slot may have a larger width in the second state is larger than the width in the first state.

In another aspect, the present disclosure is directed towards an expanding lattice notch antenna having a base plate having first and second opposing surfaces, a first plurality of notch elements coupled to the first surface of the base plate in a first orientation and a second plurality of notch elements having a first state and a second state. The second plurality of notch elements in the second state can be coupled to the first surface of the base plate in a second orientation and coupled to at least one notch element of the first plurality of notch elements. The first orientation may be perpendicular to the second orientation. In an embodiment, the second plurality of notch elements can have a larger length in the second state than in the first state.

In some embodiments, a plurality of notch antenna elements can be formed by intersecting the first plurality of notch elements and the second plurality of notch elements. A base area of each of the plurality of notch antenna elements can be less than a top area of each of the plurality of notch antenna elements.

In some embodiments, the first plurality of notch elements can be formed into a plurality rows with each of the plurality of rows having two or more notch elements coupled together. A groove can be formed in a top portion of each of notch element in the first plurality of notch elements to couple the respective first plurality of notch elements to at least one notch element in the second plurality of notch elements.

In some embodiments, the second plurality of notch elements can be formed into a plurality of rows with each of the plurality of rows having two or more notch elements coupled together. A slot can be formed in a middle portion of each notch element in the second plurality of notch elements to receive at least one notch element in the first plurality of notch elements. In an embodiment, the slot can have a larger width in the second state than in the first state.

In some embodiments, the second plurality of notch elements can be coupled to the first plurality of notch elements such that an intersection between them includes an edge of at least one notch element in the second plurality of notch elements and an edge of at least one notch element in the first plurality of notch elements. The first plurality of notch elements and the second plurality of notch elements may comprise the same material.

BRIEF DESCRIPTION OF THE DRAWINGS

The foregoing features may be more fully understood from the following description of the drawings in which.

DETAILED DESCRIPTION

The present disclosure is directed methods for forming a notch array antenna (or more simply "notch array") comprised of a plurality of notch antenna elements (or more simply, "notch elements" or "notches") projecting from a surface of a base plate at varying angles to provide an array having an expanding notch element structure. Such an expansion may eliminate the need for dilation layers and for additional packaging space and also provides the array having an increased aperture size. A resulting increase in array aperture size can provide improved gain for a notch array. This approach may be utilized with linear arrays, planar arrays or any other array configuration.

In some embodiments, the dimensions of one notch antenna element relative to another notch element can be manipulated (e.g., stretched) to expand on array lattice spacing without changing an overall height of the notch array. This avoids an increase to an overall array depth and also avoids additional path losses associated with using a separate dilation layer. By varying the lengths of the angled notch antenna elements, a lattice dimensional change (e.g., an effective increase or decrease in antenna element spacing) in the notch array can be provided. Furthermore, the expanding lattice notch antenna allows optimum sizing of a final array aperture while maintaining a planar surface as compared to a conformal array which attempts to follow an outer surface of the platform and thus causing other significant engineering difficulties.

Figure 1:
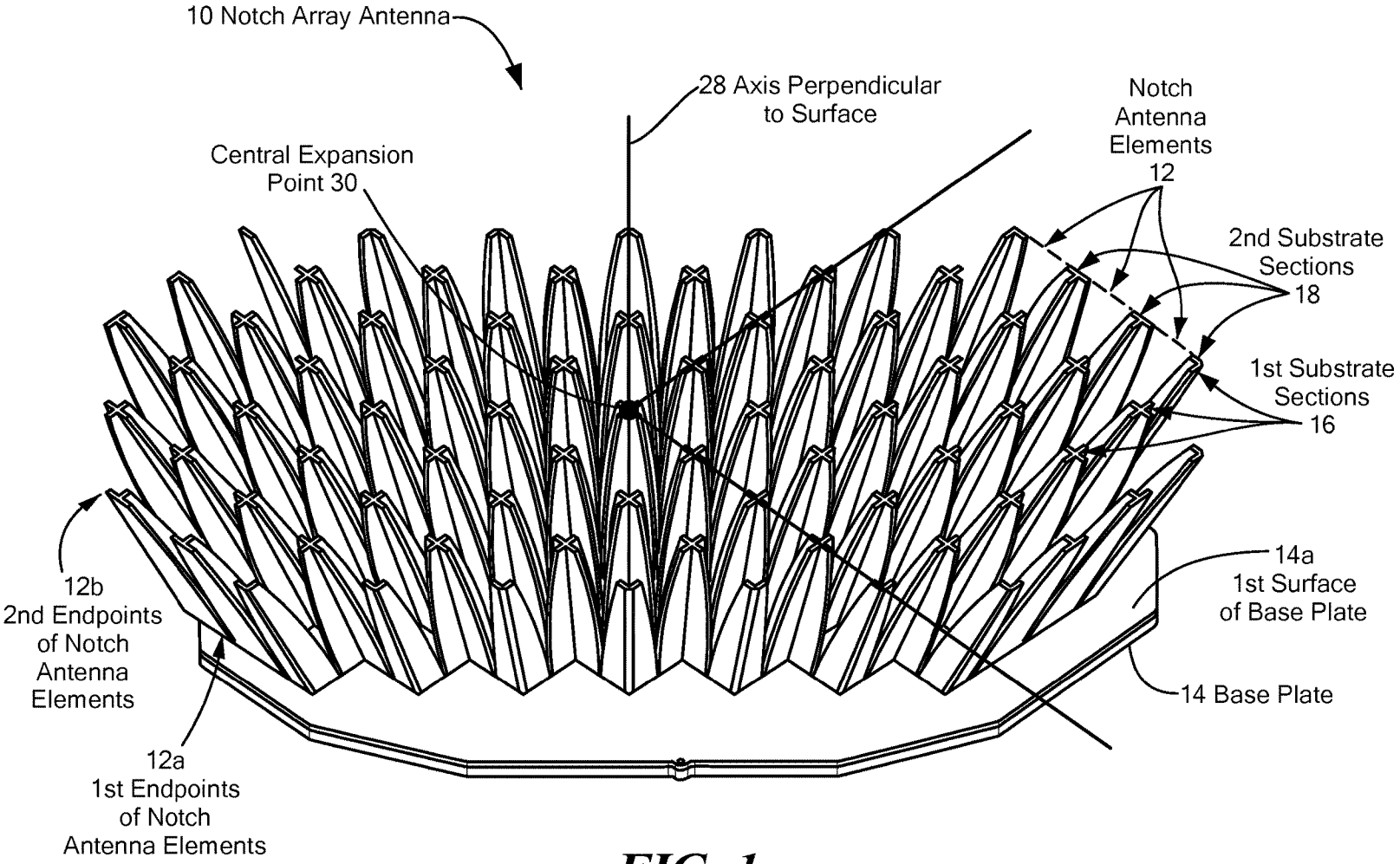
FIG. 1 is an isometric view of an expanding lattice notch array antenna formed on a base plate.
Figure 1A:
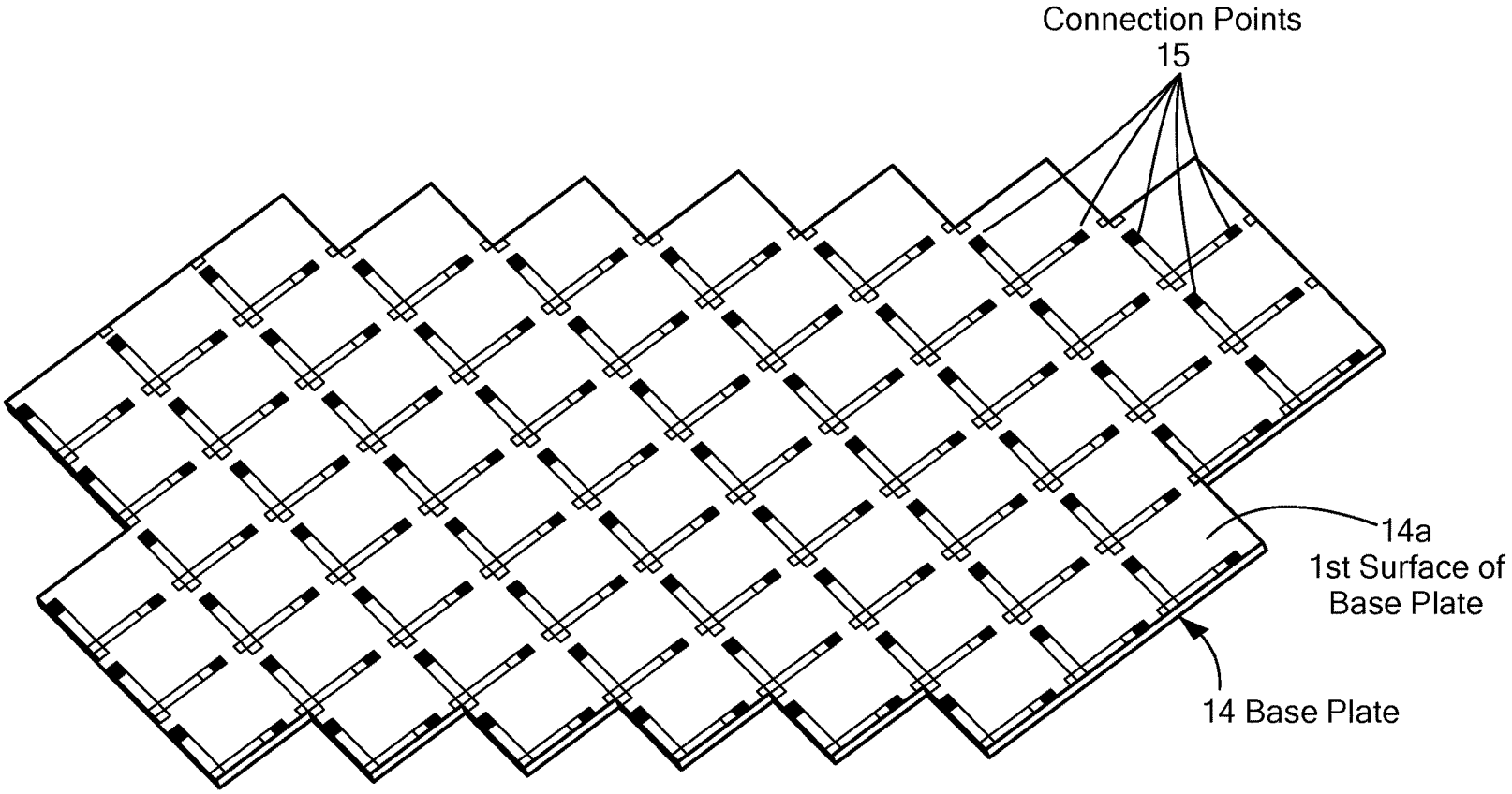
FIG. 1A is a top view of a base plate from the expanding lattice notch array antenna from FIG. 1.
Figure 1B:
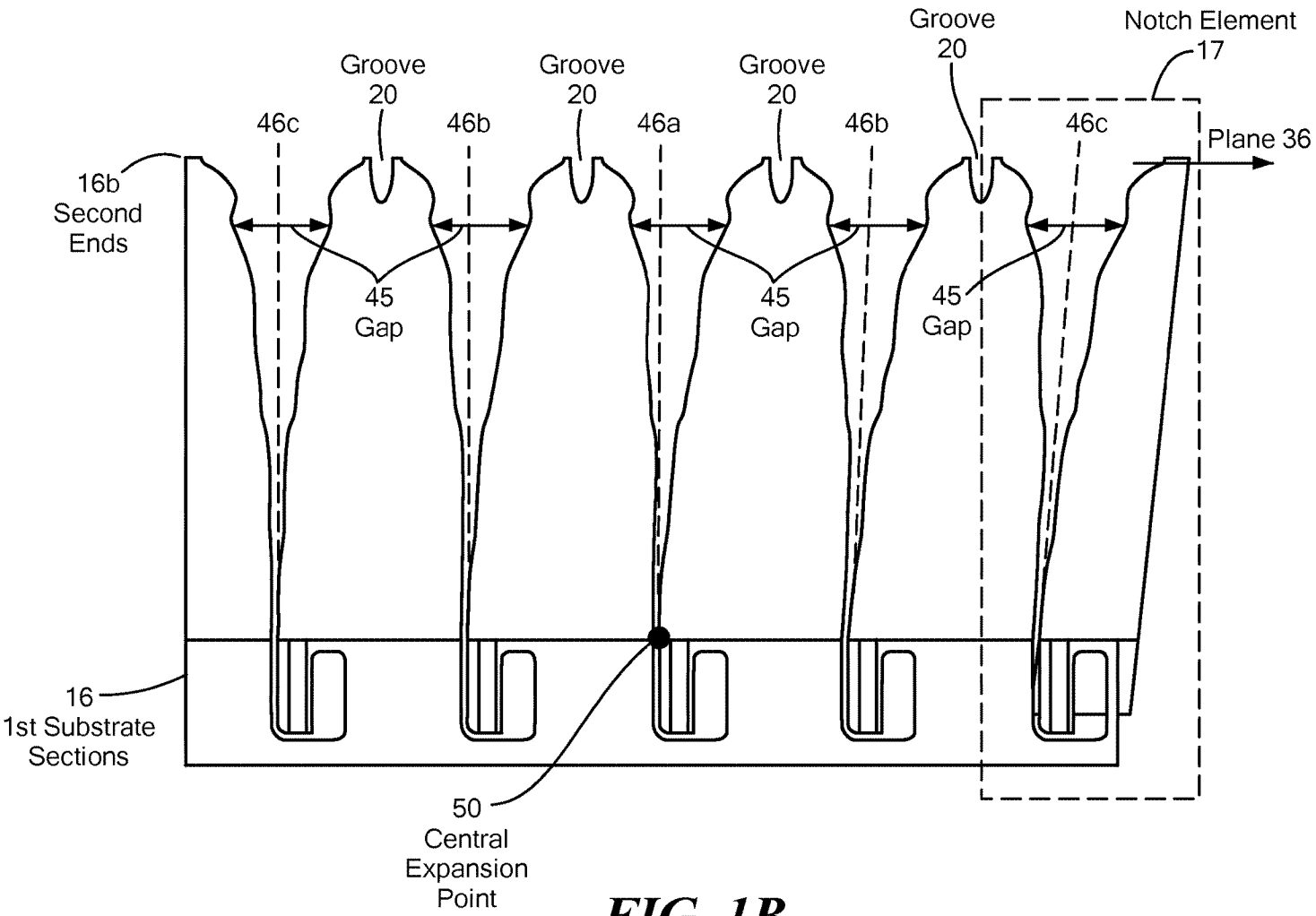
FIG. 1B is a front view of a first linear array of notch elements.
Figure 1C:
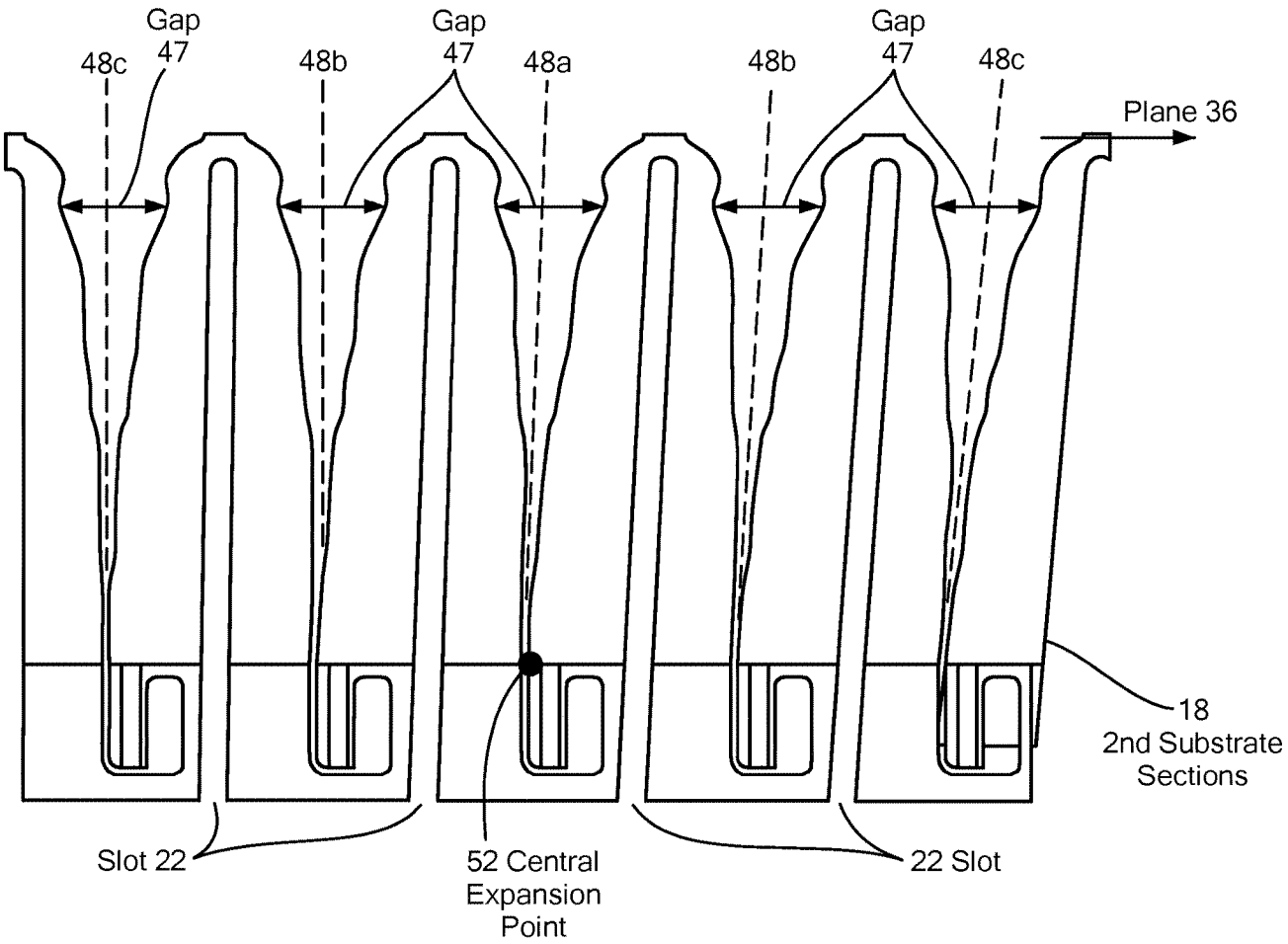
FIG. 1C is a front view of a second linear array of notch elements.

Now referring to FIGS. 1-1C, in which like elements are provided having like reference designations throughout several views, a notch array antenna 10 includes a plurality of notch antenna elements 12 extending from a first surface 14*a* of a base plate 14. Notch antenna elements 12 extend (or project) from the base plate 14 at varying angles to provide notch array antenna 10 with a so-called "expanding element structure" or "expanding lattice spacing".

In some embodiments, the notch antenna elements 12 are coupled directly to the first surface 14*a* of the base plate 14 using connection points and/or epoxy or other fastening means known to those of ordinary skill in the art including, but not limited to, solder, mechanical fasteners, (e.g. screws, rivets, and the like), and joint connections. For example, connection points, such as cuts or grooves, may be formed into the first surface to receive first end points 12*a* of the plurality of notch antenna elements 12. In some embodiments, the first end points 12*a* of the plurality of notch antenna elements 12 may be epoxied or otherwise attached to the first surface 14*a*.

First end points 12*a* of the notch antenna elements 12 are organized in a regular spacing in one or more directions along the first surface 14*a*. In the illustrative embodiment of FIG. 1, the notch antenna elements 12 are provided as dual polarized notch antenna elements and are disposed in two orthogonal directions (i.e., x and y directions) along first surface 14*a*. Thus, notch array antenna 10 is provided as a so-called dual polarized planar notch array. It should, of course, be appreciated that the concepts, systems, and techniques described herein may be applied to single polarization notch elements and to linear notch arrays or any other array configuration. Notch Array Antenna 10 may be the same as or similar to the types described in U.S. patent application Ser. No. 14/958,235, filed on Dec. 3, 2015, which is incorporated herein by reference in its entirety.

Notch antenna elements 12 may be organized relative to an axis 28 that is perpendicular to the first surface 14*a* of the base plate 14 and relative to a central expansion point 30 (i.e. a center of lattice expansion). Thus, in the illustrative embodiment of FIG. 1, a number of unique notch subassemblies are axially symmetric about the center of element expansion 30.

In the notch array antenna 10, one or more of the notch array elements 12 may have different dimensions and properties than other elements in the array. For example, the notch elements may have different lengths and/or extend at different angles from the first surface 14*a*. By varying angles, dimensions and possibly other properties of the notch array elements 12, an expanding lattice notch antenna can be provided whereby an area of a first end (e.g., top, bottom) of the notch array antenna 10 may be greater than an area of a second end (e.g., top, bottom) of the notch array antenna 10. Furthermore, as will be discussed in greater detail below, a spacing between the notch antenna elements 12 at the first end 12*a* may be different from the spacing between the notch antenna elements 12 at the second end 12*b* to provide the larger area (i.e., an increased array aperture size) and an improved gain for the notch array antenna 10.

The notch antenna elements 12 include first substrate sections 16 and second substrate sections 18. The first substrate sections 16 may be organized in a first direction (or orientation) along the first surface 14*a* and the second substrate sections 18 may be organized in a second, different direction (or orientation) along the first surface 14*a*. In some embodiments, the first direction is perpendicular to the second direction. In an embodiment, each notch antenna element 12 may include two first substrate sections 16 or two second substrate sections 18. In some embodiments, the first and second substrate sections 16, 18 may be made or formed from the same material (e.g., aluminum). In other embodiments, the first and second substrate sections 16, 18 may be made from different materials.

The materials may be selected based on their respective flexibility, thermal conductivity, and electrical conductivity properties. In some embodiments, the materials used to form first and second substrate sections 16, 18 may be selected based upon a degree of flexibility or freedom of the material. For example, the ability of the material to stretch from a first state (i.e., relaxed state) to a second state (i.e., stretched state). It should be appreciated that the first and second substrate sections 16, 18 may be made or formed from a variety of different materials, including but not limited to metals, metal alloys and plastics. For example, the first and second substrate sections 16, 18 may be made or formed from steel, titanium, copper zinc, copper alloys, aluminum alloys, aluminum/lithium and aluminum/beryllium. In other embodiments, the first and second substrate sections 16, 18 may be made or formed from injected molded plastics with the appropriate platings or printed circuit board materials. The materials listed above are provided as examples and are not intended to limit the scope of the materials that may be used to form the first and second substrates 16, 18.

As illustrated in FIG. 1, first and second substrate sections 16, 18 are organized along the first surface 14*a* such that they intersect to form the plurality of notch antenna elements 12 in two directions. For example, first and second substrate sections 16, 18 are coupled to the first surface 14*a* such that an intersection between them includes an edge of at least one first substrate section 16 and an edge of at least one second substrate section 18. In some embodiments, first and second substrate sections 16, 18 are organized into a plurality of rows (e.g., linear array of notch elements or substrate sections) with each row having two or more first substrate sections 16 or two or more second substrate sections 18.

In the notch antenna array 10, one or more of the first and second substrate sections 16, 18 may have different dimensions and properties than other respective first and second substrate sections 16, 18 in the array. For example, the first and second substrate sections 16, 18 may have different lengths and/or extend at different angles from first surface 14*a*. Thus, a spacing between the first and second substrate sections 16, 18 at the first end 12*a* may be different from the spacing between the first and second substrate sections 16, 18 at the second end 12*b* to provide the larger area (i.e., an increased array aperture size) and an improved gain for the notch array antenna 10.

Now referring to FIG. 1A, a base plate 14 includes a first surface 14*a* having a plurality of connection points 15 formed or otherwise provided in or on the surface. In one illustrative embodiment, the connection points 15 may include cuts, grooves or other forms of indentations formed into the first surface 14*a* for receiving end points of notch antenna elements 12, to couple the notch antenna elements 12 to the base plate 14. The connection points 15 may be organized in a regular spacing in one or more directions along the first surface 14*a*. For example, in some embodiments, the connection points 15 are formed in two directions (i.e., two orientations) to support and provide for notch antenna elements disposed along the first surface 14*a* in at least two directions.

In some illustrative embodiments, the connection points 15 may be organized such that they are spaced equally from neighboring or adjacent connection points. For example, a first connection point 15 may be spaced the same distance from its neighboring or adjacent connection points than a second connection point 15 is spaced from its respective neighboring or adjacent connection point. Thus, the connection points 15 may be organized into a plurality of unit cells having the same or substantially similar area along the first surface 14*a*.

In other illustrative embodiments, one or more connection points 15 may be spaced a different distance from a neighboring or adjacent connection point than a second connection point 15 is spaced from its respective neighboring or adjacent connection point.

It should be appreciated that the base plate 14 may be made or formed from a variety of different materials, including but not limited to metals, metal alloys and plastics. The material of the base plate 14 may be selected based upon requirements of a particular design or application. For example, the base plate 14 may be made or formed from steel, titanium, copper zinc, copper alloys, aluminum alloys, aluminum/lithium and aluminum/beryllium. In other embodiments, the base plate 14 may be made or formed from injected molded plastics with the appropriate platings or printed circuit board materials. The materials listed above are provided as examples and are not intended to limit the scope of the materials that may be used to form the base plate 14.

Now referring to FIG. 1B, a first plurality of notch elements (e.g., a linear array of first notch elements, a plurality of first substrate sections) are provided from a plurality of adjacently disposed substrate sections 16. Each substrate section 16 is disposed such that a gap 45 exists there between. Thus, taking substrate sections 16*a*, 16*b*, as representative of each substrate section 16, substrate sections 16*a*, 16*b* are disposed so as to form a gap 45 having a desired shape and length as is generally known, such that substrates sections 16*c*, 16*b* and gap 45 provide a notch element 17. The first plurality of notch elements 16 are illustrated in a linear array with each notch element having a cutout or groove 20 formed into a top position of the respective notch element 16. As stated above, a notch antenna element may be provided from portions (e.g., halves) of two substrate sections 16. In some embodiments, the first substrate sections 16 may be provided from a substrate having conductive regions disposed thereon or removed to form the notch. In other embodiments, conductors may be cut or otherwise formed to provide the two substrate portions 16 (e.g., first and second fins) forming a notch antenna element.

Two adjacent sections 16 form a gap 45 there between. In an embodiment, gap 45 forms a notch antenna element. In an illustrative embodiment, the substrate sections 16 are provided as a pair of conductive fin-shaped members projecting from the first surface 14*a* of the base plate 14 to form a notch element. The gap 45 increases along the length or height of the respective substrate section 16 to match a transmission line impedance at the base plate portion of the element to a free space impedance at an opposite or top portion of the substrate section 16. In some embodiments, the gap 45 for each substrate section 16 may be the same size at any particular height as measured along a z-axis projecting from a surface of the base plate 14. Alternatively, the size of gap 45 for one or more substrate sections 16 may be different from another substrate section 16 at any particular height above the base plate 14. In some embodiments, each of the substrate sections 16 in the notch antenna array 10 may be substantially similar with respect to each other in terms of material, shape and properties.

In an embodiment, a notch element axis 46*a*-46*c* is defined along a centerline of each gap 45 which form the notch element (i.e., a centerline between two adjacent first substrate sections 16). It should be noted that the first substrate sections 16 can have a vector describing the gap 45 (e.g., a line orthogonal to axis 46 at given height in a z-axis above the base plate 14) that is parallel in two orthogonal polarizations planes. In an embodiment, first substrate section 16 forms a so-called "tapered" notch element. It should, of course, be appreciated that so-called "stepped", or other types of notch elements may also be used.

Each of the first substrate sections 16 can be arranged such that their respective axes 46*a*-46*c* extend from the first surface 14*a* of the base plate 14 at systematically varying angles with respect to a central expansion point 50 and/or a normal axis perpendicular to the surface of the first surface 14*a*, such that a plurality of end points at second ends 16*b* of the first substrate sections 16 lie on a plane 36 spaced apart from and parallel to a plane defined by the surface 14*a* of the base plate 14. Thus, the element centerlines (and thus the notches) are not parallel and thus are not symmetric. Breaking the symmetry between the first substrate sections 16 (and notch antenna elements formed by the first plurality of notch elements) in this way permits an area expansion of the notch array antenna aperture.

In an illustrative embodiment, each first substrate section 16 includes grooves 20 to receive a second substrate section 18. For example, in some embodiments, the grooves 20 are formed or otherwise provided to receive a slotted portion 22 formed into the second substrate section 18. Thus, the second substrate section 18 may be disposed over the first substrate section 16.

The grooves 20 may be formed in a variety of different shapes (e.g., semicircle, oval, rectangular, etc.) and a variety of dimensions according to dimensions of respective second substrate section and the particular application of the notch array antenna. The dimensions of the grooves 20 can be scaled according to the dimensions of the slots formed in second substrate sections. In an embodiment, a length of the grooves 20 may be selected based upon an amount of stretch needed out of a respective first substrate section 16, second substrate section 18 or both. In some embodiments, the dimensions of the grooves 20 may be selected based upon the type of material used to form the first and second substrate 16, 18.

Now referring to FIG. 1C, a plurality of second notch elements 18 (e.g., a linear array of second notch elements, a plurality of second substrate sections) are illustrated with each element having a slot 22 formed into a middle portion of the respective second substrate section 18. A notch antenna element may include portions (e.g., halves) of two second substrate sections 18. In some embodiments, the second substrate sections 18 may be provided from a substrate having conductive regions disposed thereon or removed to form the notch. In other embodiments, conductors may be cut or otherwise formed to provide the two portions of the second substrate sections 18 (e.g., first and second fins) forming a notch antenna element.

A gap 47 can be formed between two adjacent second substrate sections 18. In an embodiment, a notch antenna element can be formed by a gap between a pair of portions of the second substrate sections 18 (i.e., a pair of conductive fin-shaped members) projecting from the first surface 14*a* of the base plate 14. The gap 47 increases along the length or height of the second substrate section 18 to match a transmission line impedance at the bottom to a free space impedance at the top. In some embodiments, the gap 47 for each second substrate section 18 may be the same size at any particular height, along a z-axis above the base plate 14. Alternatively, the size of gap 47 for one or more second substrate sections 18 may be different from another second substrate section 18 at any particular height above the base plate 14. In some embodiments, each of the second substrate sections 18 in the notch antenna array 10 may be substantially similar with respect to each other in terms of material, shape and properties.

It should be noted that the second substrate sections 18 can have a vector describing gap 47 (e.g., a line orthogonal to an axis 48 at given height in a z-axis above base plate 14) that is parallel in two orthogonal polarizations planes. In an embodiment, second substrate sections 18 forms a tapered notch element. However stepped, or other types of notch elements may also be used.

Further, a notch element axis 48*a*-48*c* is defined along a centerline of each gap 47 (i.e., a centerline between two adjacent second substrate sections 18). Similar to first substrate sections 16 discussed above, each of the second substrate sections 18 are arranged such that the axes 48*a*-48*c* extend from a first surface 14*a* of a base plate 14 at systematically varying angles with respect to a central expansion point 52 and a normal axis perpendicular to the first surface 14*a*, such that a plurality of end points at second ends 18*b* of the second substrate sections 18 lie on the plane 36 spaced apart from and parallel to a plane defined by the surface 14*a* of the base plate 14. Thus, the element centerlines (and thus the notches) are not parallel and thus are not symmetric. Breaking the symmetry between the second substrate sections 18 (and notch antenna elements formed by the first substrate sections 16) in this way permits an area expansion of the notch array antenna aperture.

In an embodiment, each second substrate section 18 includes a slot 22 to receive a first substrate section 16. For example, in some embodiments, the slots 22 are formed to receive the groove portion 20 of the first substrate section 16. Thus, the second substrate sections 18 may be disposed over the first substrate sections 16 and coupled to the first surface 14*a* of the base plate 14.

In an embodiment, the slots 22 may be generally formed as long, narrow apertures into middle portions of the second substrate sections 18. It should be appreciated that the slots 22 may be formed in a variety of different shapes and a variety of different dimensions according to dimensions the particular design and application of the notch array antenna. In some embodiments, the dimensions of the slots 22 are scaled according to the dimensions of the grooves 20 formed in the first substrate sections 16.

Still referring to FIGS. 1-1C, the respective axes 46*a*, 48*a* of first and second substrate sections 16, 18 nearest to the respective central expansion point 50, 52 extend at angle from the first surface 14*a* of the baseplate 14 which is almost perpendicular from the first surface 14*a*. However, as a distance from which either a first and second substrate sections 16, 18 is spaced from the central expansion point 50, 52 increases, the angle at which the axis 46*a*-46*c*, 48*a*-48*c* of the respective first and second substrate sections 16, 18 extends from the surface of the base plate 14 changes. In this illustrative embodiments of FIGS. 1B and 1C, the angle of the axis 46*a*-46*c*, 48*a*-48*c* as measured from an outermost edge of the array and from the first surface 14*a* decreases.

For example, the angle of axis 46*b* (FIG. 1B) is different (e.g. greater than, depending upon how the angle is defined and measured) the angle of axis 46*c* (FIG. 1B). Similarly, the angle of axis 46*b* (FIG. 1C) is different (e.g. greater than) the angle of axis 48*c* (FIG. 1C). Furthermore, in such an embodiment, as the distance from which the first and second substrate sections 16, 18 are spaced from the central expansion point 50, 52 on the base plate increases, a length of the respective first or second substrate sections 16, 18 increases relative to a first or second substrate sections 16, 18 nearer to the central expansion point 50, 52. Increasing the length of the spaced first or second substrate sections 16, 18 results in the second ends of each of the first or second substrate sections 16, 18 terminating in the same plane (e.g., plane 36 in FIGS. 1B-1C).

Figure 2:
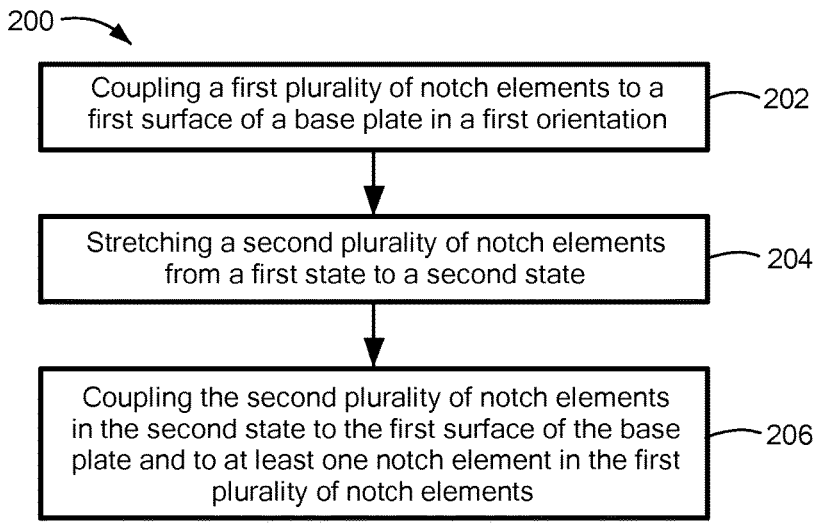
FIG. 2 is flow diagram of a method for forming an expanding lattice notch array antenna.

Now referring to FIG. 2, in brief overview, a method 200 for forming an expanding lattice notch antenna includes coupling a first plurality of notch elements to a first surface of a base plate in a first orientation (202) and expanding (or stretching) a second plurality of notch elements from a first (or resting) state to a second (or stretched) state such that in the second state, the second plurality of notch elements have a length (relative to a plane parallel with the first surface of the base plate) which is larger than a length in the first state (204). The method 200 further includes coupling the second plurality of notch elements in the second state to the first surface of the base plate in a second orientation (206). In an embodiment, each of the second plurality of notch elements is coupled to at least one of the first plurality of notch elements.

A base plate having first and second opposing surfaces may be prepared for coupling notch elements (or more particularly the structures from which the notch elements are provided) to at least one surface. In an embodiment, a plurality of connections points may be formed into the first surface to receive end points of notch elements (e.g., substrate sections). The connections points can be cuts, grooves or other forms of indentations configured to receive the end points. The connections points may be formed to provide for notch elements to be disposed in one or more directions along the first surface. For example, in some embodiments, connections points are formed to provide for notch elements to be disposed in two directions (e.g., x and y plane) along the first surface.

The connection points may be formed with equal spacing such that adjacent connections points are spaced the same distance from each other. Thus, the arrangement of connection points on the first surface forms a plurality of unit cells along the first surface, each having the same or substantially similar areas. In other embodiments, one or more connection points may be spaced a different distance from adjacent connection points than a second connection point is positioned from its respective adjacent connection points.

At 202, a first plurality of notch elements can be coupled to the first surface of the base plate in a first orientation (direction) using the connection points formed into the first surface. In some embodiments, the first plurality of notch elements may be epoxied or otherwise attached or fastened to the first surface in addition to coupling through the connections points.

Figure 3:
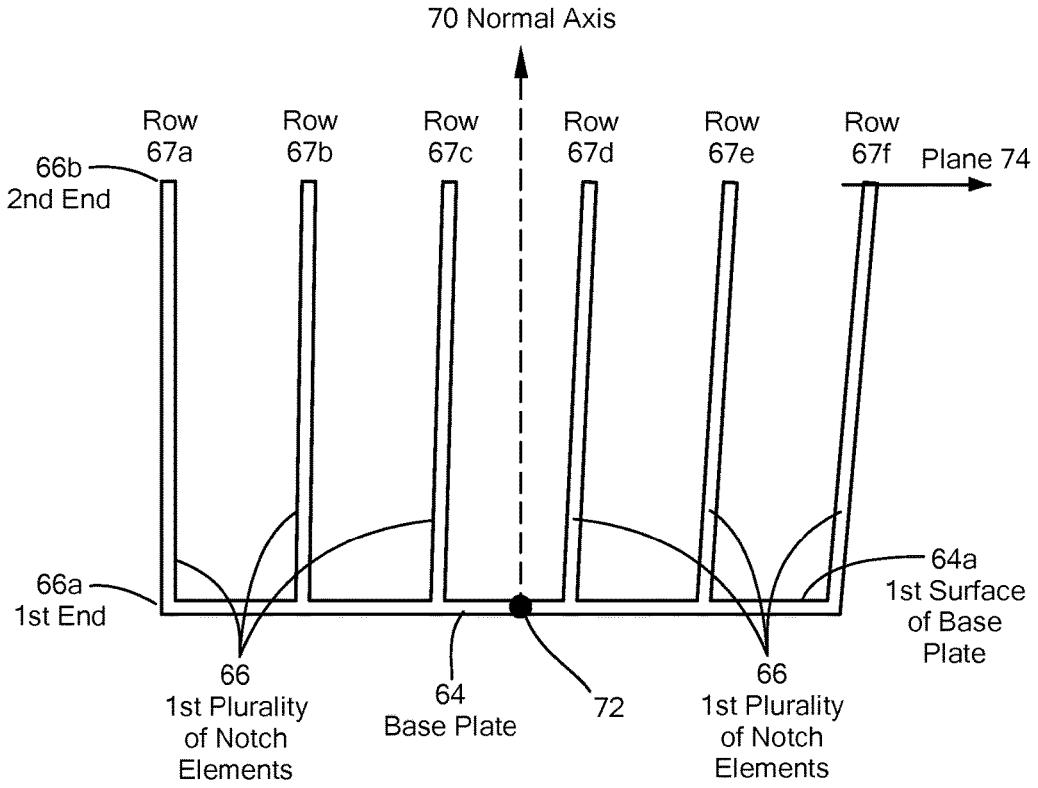
FIG. 3 is a front view of a plurality of rows of first linear arrays of notch elements coupled to a base plate.

In some embodiments, the first plurality of notch elements are formed or otherwise provided as rows prior to coupling to the first surface with each row having two or more notch elements. Thus, individual rows of notch elements may be coupled to the first surface at a time. For example and referring to FIG. 3, the first plurality of notch elements 66 (here illustrated as a first linear array of notch elements and also referred to herein as notch elements 66) may be formed into rows 67*a*-67*f* Next, rows 67*a*-67*f* of notch elements 66 may be coupled to a first surface 64*a* of a base plate 64 in a first orientation. In the illustrative embodiment of FIG. 3, each of the rows 67*a*-67*f* are spaced equidistant from each other.

Further, each row may disposed on the first surface 64*a* at systematically varying angles with respect to normal axis 70 of a central expansion point 72, such that a plurality of end points at second ends 66*b* of the first plurality of notch elements 66 on a plane 74 spaced apart from and parallel to a plane defined by the first surface 64*a*. For example, the second ends 66*b* of the first plurality of notch elements 66 begin to taper or flare the further away they are spaced from the central expansion point 72. Thus, the rows 67*a*-67*f* are not parallel and thus are not symmetric. Breaking the symmetry between the notch elements in the first plurality of notch elements in this way permits an area expansion of the notch array antenna aperture.

Referring back to FIG. 1, at 204, a second plurality of notch elements may be expanded from first state to a second state. The second plurality of notch elements may be expanded (or stretched) such that they have a longer length relative to a plane parallel with the first surface of the base plate in the second state than in the first state. In an embodiment, the second plurality of notch elements may be expanded in order to fit over the tapered array defined by the second ends points of the first plurality of notch elements.

Figure 3A:
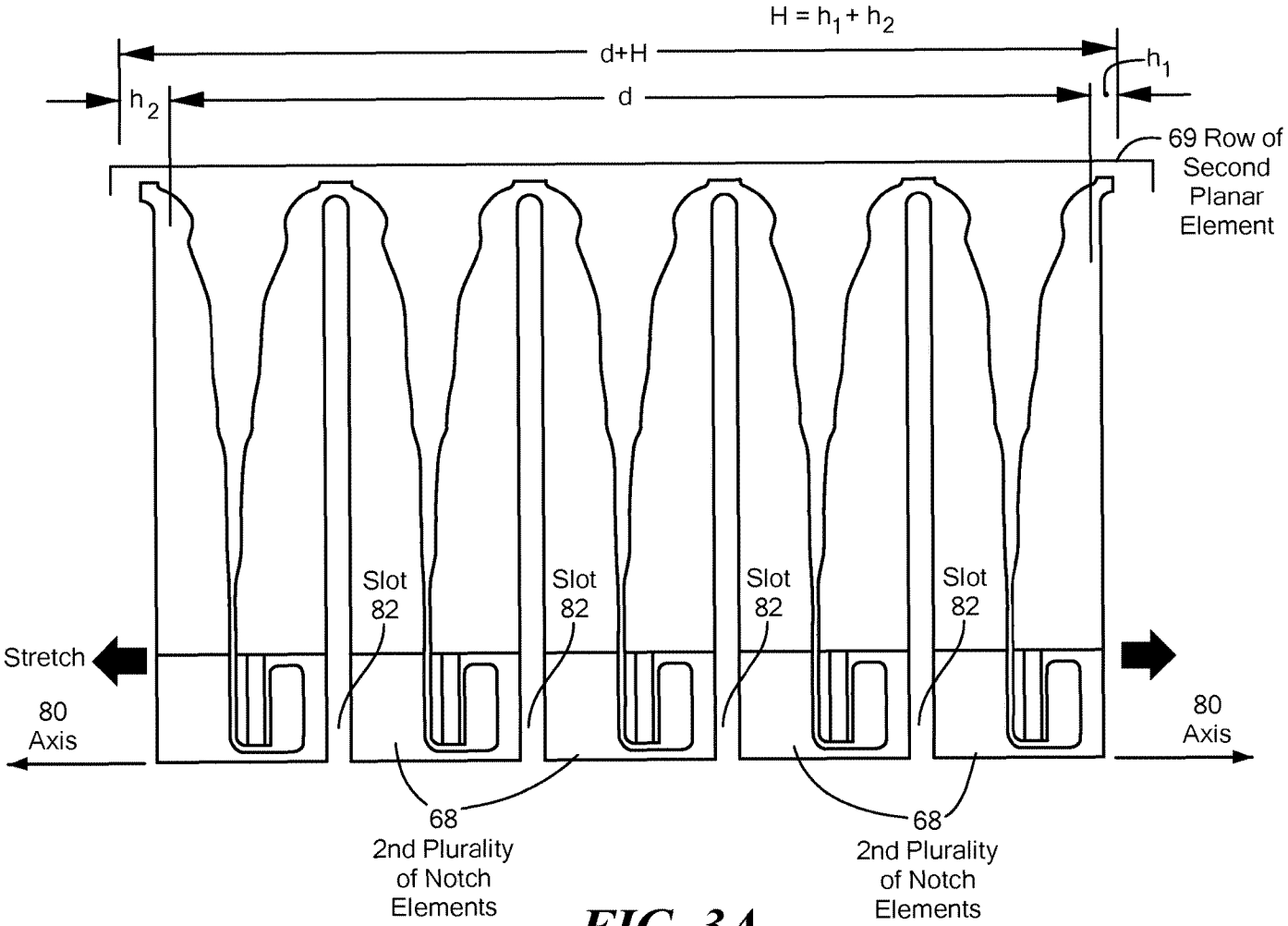
FIG. 3A is a front view of a second linear array of notch elements being expanded from a first state to a second state.

For example, and referring to FIG. 3A, a second plurality of notch elements 68 (here illustrated as a second linear array of notch elements) may be expanded from a first state to a second state. The second plurality of notch elements 68 (also referred to herein as notch elements 68) form a row 69 having two or more notch elements 68. The notch elements may be formed from material having a specific degree of flexibility (or degree of freedom) to allow a desired expansion (i.e. an expansion from length d in a first (or resting) state to a length d+H in a second (or stretched) state). In some embodiments, the notch elements in the second plurality of notch elements 68 may be manipulated (e.g., forming slots 82 into a middle portion) to create or increase a degree of flexibility or freedom to meet a desired expansion ratio for a particular application. Thus, the row 69 of notch elements 68 may have a larger length in the second state than in the first state. In some embodiments, the row 69 of notch elements 68 can expand laterally along an axis 80 that is parallel to a plane defined by the first surface of the base plate when being stretched from the first state to the second state.

Each notch element in the second plurality of notch elements 68 can include a slot 82 formed into a central or middle portion thereof. In some embodiments, the degree of expansion may correspond to the dimensions and/or geometry (i.e., length, width) of the slot 82. As the second plurality of notch elements 68 are stretched, the slots 82 of each element may change (i.e. increase or decrease certain dimension). For example, the slots 82 may be formed to have a first state (i.e., relaxed state) and a second state (i.e., stretched state). Thus, portions of each of the slots 82 may expand from the first state to the second state. A width of the slots 82 may be larger in the second state than in the first state. In some embodiments, in the second state, the slots 82 are orthogonal to the plane defined by the first surface of the base plate.

In an embodiment, each of the slots 82 formed in notch elements of the row 69 can have the same dimensions and/or geometry. It should be appreciated however, that in other embodiments, the dimensions of the slots 82 may vary from between different notch elements in a single row, in different rows or in a single notch array antenna depending upon the needs of a particular application.

Although portions of the above description describe expanding (stretching) a second plurality of notch elements, it should be appreciated that in other embodiments, the first plurality of notch elements (e.g., plurality of first notch elements 66 of FIG. 3) may be expanded (stretched) instead of the second plurality of notch elements to provide an expanding lattice notch array antenna. In still other embodiments, both the first and second plurality of notch elements may be expanded (stretched) in order to provide an expanding lattice notch array antenna.

Referring back to FIG. 2, at 206, the second plurality of notch elements in the second state can be coupled to the first surface of the base plate in a second orientation. In an embodiment, each of the second plurality of notch elements are coupled to at least one notch element of the first plurality of notch elements. In some embodiments, the second orientation is perpendicular to the first orientation.

Figure 3B:
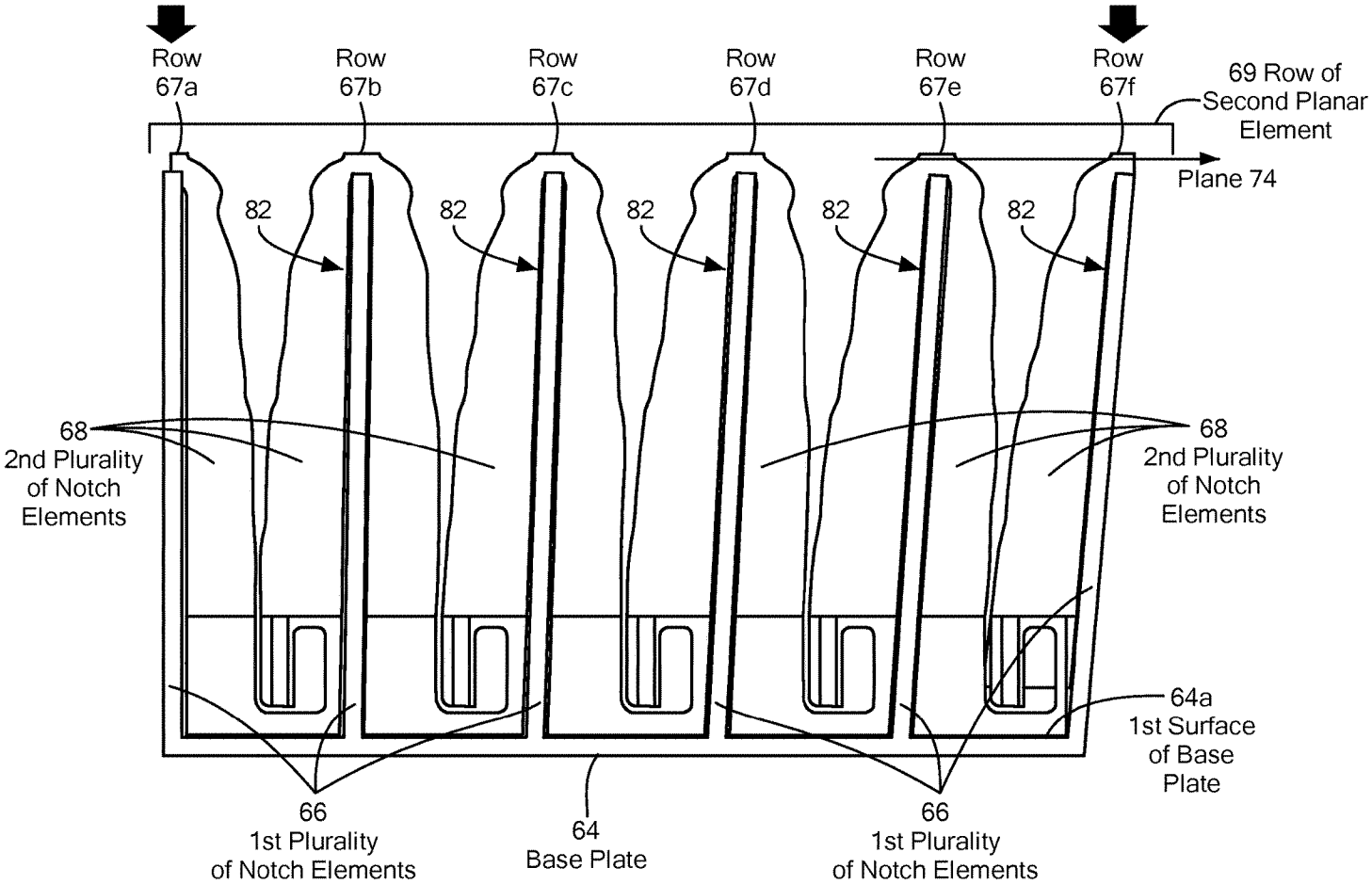
FIG. 3B is a front view of a second linear array of notch elements coupled to a plurality of rows of first linear arrays of notch elements and a base plate.

For example, and referring to FIG. 3B, the row 69 of notch elements 68 can disposed over rows 67*a*-67*f* of notch elements 66 and be coupled to the first surface 64*a* of the base plate 64. The rows 67*a*-67*f* of notch elements 66 are disposed in a first orientation and the row 69 of notch elements 68 is disposed in a second orientation. In the illustrative embodiment of FIG. 3B, the first orientation is perpendicular to the second orientation.

Although not shown in FIG. 3B due to the angle at which the rows 67*a*-67*f* are positioned, each notch element in the first plurality of notch elements 66 each includes a groove (similar to grooves 20 illustrated in FIG. 1B) formed into a top portion thereof to receive the slots 82 in the notch elements of the second plurality of notch elements 68. Thus, the slot 82 of notch elements 68 can be disposed over the grooves of notch elements 66 so as to couple the two sets of notch elements. It should, of course, be appreciated that other mechanical coupling features (i.e. other than slots) may be used to couple two notch elements or two arrays of notch elements.

In an embodiment, the row 69 of notch elements 68 can be coupled to connections points formed in the first surface 64*a*. Further, the row 69 of notch elements 68 can be epoxied or otherwise coupled to the connection points formed in the first surface 64*a* and/or the first surface 64*a*.

Although FIG. 3B shows only one row 69 of notch elements 68, it should be appreciated that a plurality of rows 69 of notch elements 68 may be disposed over the rows 67*a*-67*f* of the notch elements 66 and coupled to the first surface 64*a* of the base plate 64.

In some embodiments, after the row 69 of notch elements 68 have been coupled to the first surface 64, the row 69 of notch elements 68 may contract from the second state (i.e., stretched state) toward the first state (i.e., relaxed state). Further, each of the slots 82 of notch elements 82 may contract from the second state (i.e., stretched state) to the first state (i.e., relaxed state). For example, a width of the slots 82 may be smaller in the first state than in the second state. Thus, notch elements 68 may be tightly coupled to notch elements 66 such that the dimensions of the slot 82 are substantially equal to the dimensions of the notch elements in the second orientation. For example, the inner walls of the slots 82 may be in contact with the outer walls of the notch elements in the first plurality of notch elements 66 in the first state to form a tight connection.

In an embodiment, a plurality of notch antenna elements are formed on the first surface 64*a* of the base plate 64. The notch antenna elements may be arranged in one or more directions along the first surface of the base plate to form a notch array antenna. For example and referring to FIG. 3C, a dual polarized expanding notch array antenna 80 includes a plurality of dual polarized notch antenna elements 84 coupled to the first surface 64*a* of the base plate 64. In the illustrative embodiment of FIG. 3C, each of the notch antenna elements 84 includes first and second orthogonally disposed notch antenna elements, each of which is provided from respective pairs of substrate portions (or fins) 66, 68.

In the notch array antenna 80, one or more of the notch antenna elements 84 may have different dimensions and properties than other elements in the array. For example, the notch elements may have different lengths and/or extend at different angles from the first surface 64*a* of the base plate 64. By varying angles, dimensions and possibly other properties of the notch array elements 84, an expanding lattice notch antenna is provided whereby an area of a first end (e.g., top, bottom) of the notch array antenna 80 may be greater than an area of a second end (e.g., top, bottom) of the notch array antenna 80. Furthermore, a spacing between the notch antenna elements 84 at the first end may be different from the spacing between the notch antenna elements 84 at the second end to provide the larger area (i.e., an increased array aperture size) and an improved gain for the notch array antenna 80.

Figure 3C:
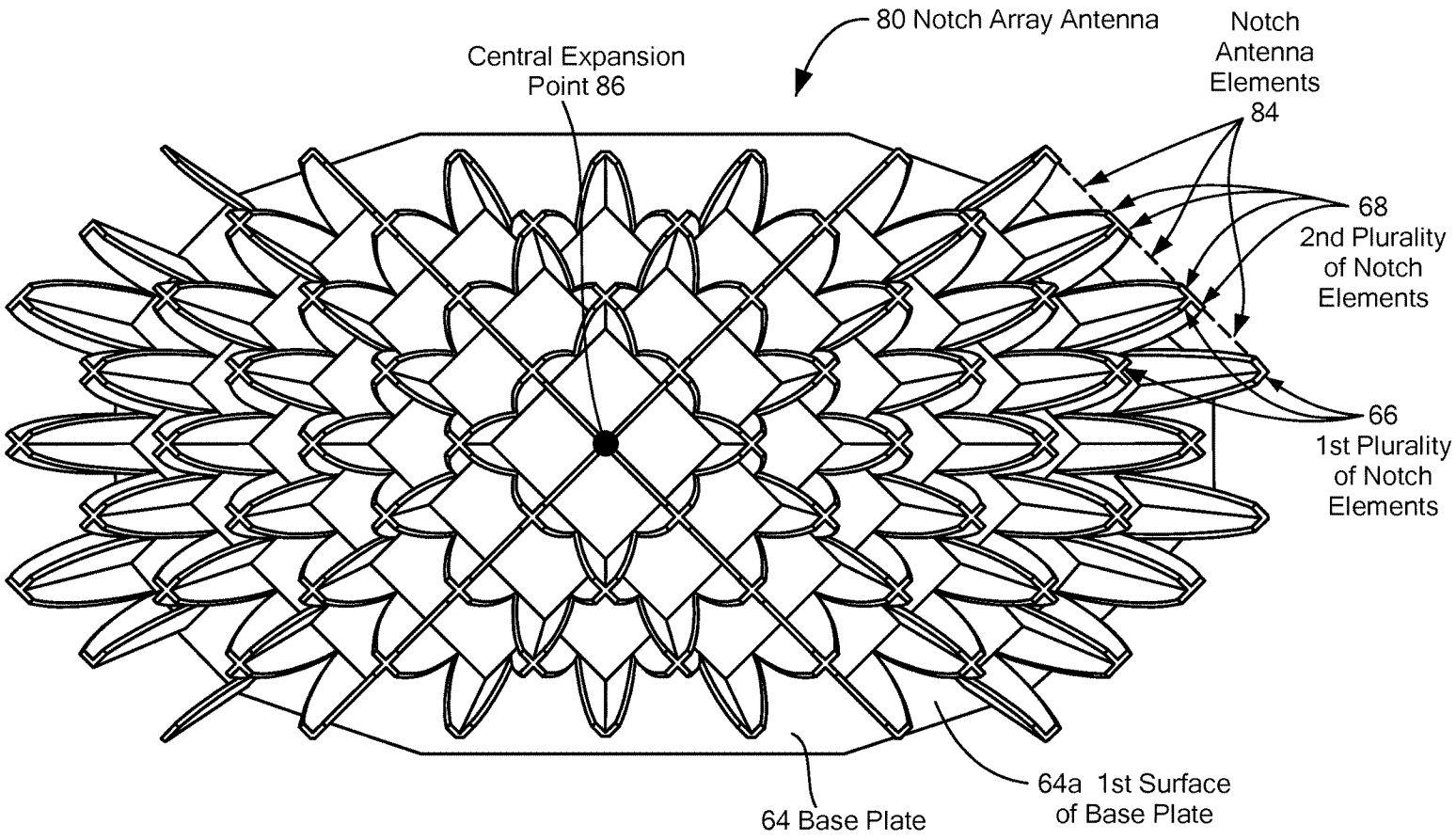
FIG. 3C is a top view of an expanding lattice notch array antenna formed on a base plate, which may be the same as or similar to the expanding notch array of FIG. 1.

As shown in FIG. 3C, the notch antenna elements 84 begin to taper or flare the further away they are spaced from a central expansion point 86. This organization of the notch antenna elements 84 provides an expansion of the notch array antenna 80. In particular, a base area (i.e. an area proximate base surface 64*a*) of the notch array antenna 80 is smaller than a top area of notch array antenna 80 (i.e. an area at the second ends of the notches distal from base surface 64*a*). For example, a base area of notch array antenna 80 may have dimensions set at below a unit cell grating lobe limit (dx, dy) based on some maximum frequency and scan angle of an intended operation and application. At the base (or bottom) of notch array antenna 80, the array conforms to these limits. However, over a length of the notch antenna elements 84, the notch array antenna 80 expands to a slightly larger notch array antenna 80 at the top (e.g., at plane 74 of FIGS. 3 and 3B), in which a center-to-center spacing at a top portion of the notch elements 84 at the array aperture is greater but still within an allowable limit based upon a grating lobe limit for the notch array antenna 80.

In an embodiment, the tilting at a different angle relative to the normal of the central expansion point 86 of one or more notch antenna elements 84 results in the expansion of the notch array antenna 80. Thus, the end result can be: (a) an increased area gain, as the tip of the notch antenna elements 84 have a larger cell size and thus lattice spacing than at the base of the notch array antenna 80; (b) no dilation losses, as there was no need to incorporate a feed distribution layer between electronics and radiator: (c) due to slight 'decollimation' of each notch antenna element 84, broadside gain is slightly decreased in exchange for slightly lower initial gain roll off with scan off broadside: and (d) there may be virtually no or very small weight change since the growth is all 'in the air' in the notch gaps of each notch antenna element 84.

For example, in one embodiment, in which the cell size is defined as $dx_1=dy_1$ at the base of the array and $dx_2=dy_2$ at the top (i.e. tip or aperture) of the array, the net area gain is the ratio of $(dx_2/dx_1)^2$. Thus, for a notch array antenna 80 having 60 notch antenna elements with 5% expansion between $dx_1$ and $dx_2$ may result in adding the area which is the equivalent of adding six (6) additional conventional unit cells. In some embodiments, the number of notch antenna elements 84 used in notch array 80 are selected such that they are axially symmetric about central expansion point 86.

It should be noted that although the central expansion point 86 is illustrated at a center of the array 80, the location of the central expansion point may be selected to suit the needs of a particular application. Thus, any point on the base of the array may be selected as an expansion point from which notch antenna elements 84 may be organized systematically according to the needs of a particular application. The expansion may begin from some selected point on base plate 64 and each subsequent notch antenna element 84, or row or column of notch antenna elements 84, can be oriented differently from a preceding one. For example, the expansion point may be offset or off-center on a surface of base plate 64 with respect to a center point of the array.

In the illustrative dual polarized planar notch array embodiment of FIG. 3C, notch antenna elements 84 nearest the central expansion point 86 may have a shorter length (as measured along a respective notch axes) relative to notch antenna elements 84 farther away from the central expansion point 86. Furthermore, notch antenna elements 84 furthest away from the central expansion point 86 may extend from the surface of the base plate 64 at a larger angle (i.e. as measured from a central longitudinal axis through the central expansion point 86) than notch antenna elements 84 closest to the central expansion point 86. That is notch antenna elements 84 closest to the central expansion point 86 are closer to perpendicular with respect to a surface of the base than are notch antenna elements 84 further away from the central expansion point 86.

By varying the lengths of the angled notch antenna elements 84, each endpoint of the plurality of notch antenna elements 84 may lie (i.e., end) in a single plane (i.e., plane 74 of FIG. 3B) that runs parallel with a plane defined by the first surface 64*a* of the base plate 64. Thus, the height of the notch array antenna 80 (i.e., the vertical distance from the first surface 64*a* to plane 74) remains the same while each of the notch antenna elements 84 "tilt" at varying angles relative to the normal of the central expansion point 86 and a bottom face of notch array antenna 80 and top face of notch array antenna 80 remain planar. Thus, the antenna aperture is in a single plane at a desired height above the base 64.

In some embodiments, each notch antenna elements 84 in array antenna 80 has the same or substantially similar design and properties as another notch antenna element 84. Alternatively, one or more notch antenna elements 84 may have varying designs or properties in array antenna 80. For example, one or more notch antenna elements 84 may have varying lengths and thus may behave differently from another notch antenna element 84 in array antenna 80.

What is claimed:

1. A method for forming an expanding lattice notch antenna, the method comprising:

coupling a plurality of first plurality of notch elements to a first surface of a base plate in a first orientation;

expanding a second plurality of notch elements from a first state to a second state, wherein the second plurality of notch elements have a length which is larger in the second state than in the first state; and coupling the second plurality of notch elements in the second state to the first surface of the base plate in a second, different orientation, each of the second plurality of second notch elements coupled to at least one of the first plurality of notch elements, wherein a base area of each of the plurality of notch antenna elements is less than a top area of each of the plurality of notch antenna elements.

2. The method of claim 1, further comprising coupling the second plurality of notch elements to the first plurality of notch elements such that intersection between them includes an edge of at least one notch element of the second plurality of notch elements and an edge of at least one notch element of the first plurality of notch elements.

3. The method of claim 2, forming a plurality of the notch antenna elements on the first surface of the base plate.

4. The method of claim 1, wherein the first orientation is perpendicular to the second orientation.

5. The method of claim 1, further comprising forming the first plurality of notch elements into a plurality of rows on the first surface of the base plate, each of the plurality of rows having two or more notch elements coupled together.

6. The method of claim 1, further comprising forming a groove in a top portion of each notch element in the first plurality of notch elements to couple the respective first plurality of notch elements to at least one notch element in the second plurality of notch elements.

7. The method of claim 1, further comprising forming the second plurality of notch elements into a plurality of rows on the first surface of the base plate, each of the plurality of rows having two or more notch elements coupled together.

8. The method of claim 1, further comprising forming a slot in a middle portion of each notch element in the second plurality of notch elements to receive at least one notch element in the first plurality of notch elements.

9. The method of claim 8, further comprising expanding the slot from a first width in the first state to a second width in the second state, wherein the slot has a larger width in the second state is larger than the width in the first state.

10. An expanding lattice notch antenna comprising:

a base plate having first and second opposing surfaces;

a first plurality of notch elements coupled to the first surface of the base plate in a first orientation; and a second plurality of notch elements having a first state and a second state, the second plurality of notch elements in the second state coupled to the first surface of the base plate in a second orientation and coupled to at least one notch element of the first plurality of notch elements, wherein the second plurality of notch elements have a larger length in the second state than in the first state, wherein a base area of each of the plurality of notch antenna elements is less than a top area of each of the plurality of notch antenna elements.

11. The antenna of claim 10, further comprising a plurality of notch antenna elements formed by intersecting the first plurality of notch elements and the second plurality of notch elements.

12. The antenna of claim 10, wherein the first orientation is perpendicular to the second orientation.

13. The antenna of claim 10, further comprising the first plurality of notch elements organized in a plurality of rows, each of the plurality of rows having two or more notch elements coupled together.

14. The antenna of claim 10, wherein a groove is formed in a top portion of each notch element in the first plurality of notch elements to couple the first plurality of notch elements to at least one notch element in the second plurality of notch elements.

15. The antenna of claim 10, further comprising the second plurality of notch elements organized in a plurality of rows, each of the plurality of rows having two or more notch elements coupled together.

16. The antenna of claim 10, wherein a slot is formed in a middle portion of each notch element in the second plurality of notch elements to receive at least one notch element in the first plurality of notch elements.

17. The antenna of claim 16, wherein the slot has a larger width in the second state than in the first state.

18. The antenna of claim 10, wherein the second plurality of notch elements are coupled to the first plurality of notch elements such that an intersection between them includes an edge of at least one notch element of the second plurality of notch elements and an edge of at least one notch element of the first plurality of notch elements.

19. The antenna of claim 10, wherein the first plurality of notch elements and the second plurality of notch elements comprise the same material.

* * * * *